US006991499B2

(12) United States Patent
Facinelli et al.

(10) Patent No.: US 6,991,499 B2
(45) Date of Patent: Jan. 31, 2006

(54) WATERJET PROPULSION APPARATUS

(75) Inventors: William Facinelli, Tempe, AZ (US); Alan J. Becnel, Severna Park, MD (US); John G. Purnell, Severna Park, MD (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/664,318

(22) Filed: Sep. 16, 2003

(65) Prior Publication Data

US 2005/0070178 A1 Mar. 31, 2005

(51) Int. Cl.
*B63H 11/103* (2006.01)

(52) U.S. Cl. ..... 440/47

(58) Field of Classification Search ..... 440/38, 440/40, 41, 42, 43, 47; 60/221, 222
See application file for complete search history.

(56) References Cited

U.S. PATENT DOCUMENTS

| | | | | |
|---|---|---|---|---|
| 2,484,554 | A * | 10/1949 | Concordia et al. | 416/88 |
| 3,405,526 | A * | 10/1968 | Aschauer | 60/221 |
| 3,601,989 | A | 8/1971 | Austin | |
| 3,985,094 | A | 10/1976 | Stricker | |
| 4,120,152 | A * | 10/1978 | Jackson, III | 60/221 |
| 4,427,338 | A * | 1/1984 | Furst | 415/210.1 |
| 4,993,977 | A | 2/1991 | Rodler, Jr. | |
| 5,266,009 | A | 11/1993 | Tasaki et al. | |
| 5,649,843 | A | 7/1997 | Elger | |
| 5,713,769 | A | 2/1998 | Jones | |
| 5,720,635 | A * | 2/1998 | Roos | 440/38 |
| 5,759,074 | A | 6/1998 | Jones | |
| 5,871,381 | A | 2/1999 | Lin | |
| 5,876,257 | A | 3/1999 | Lin | |
| 5,975,966 | A | 11/1999 | Lin | |
| 5,989,083 | A | 11/1999 | Ishigaki et al. | |
| 6,027,383 | A | 2/2000 | Broinowski | |
| 6,071,156 | A | 6/2000 | Platzer et al. | |
| 6,102,757 | A | 8/2000 | Ishigaki | |
| 6,135,831 | A | 10/2000 | Lanni et al. | |
| 6,193,571 | B1 | 2/2001 | Burg | |
| 6,238,256 | B1 | 5/2001 | Freitag | |
| 6,238,257 | B1 | 5/2001 | Platzer et al. | |
| 6,283,805 | B1 | 9/2001 | Ishigaki | |
| 6,428,370 | B1 | 8/2002 | Jones | |
| 6,500,035 | B2 | 12/2002 | Terlouw | |
| 2002/0160668 | A1 | 10/2002 | Terlouw | |
| 2003/0049978 | A1 | 3/2003 | Dusablon | |
| 2003/0054706 | A1 | 3/2003 | Fuse | |
| 2003/0060096 | A1 | 3/2003 | Fuse | |
| 2004/0009718 | A1 * | 1/2004 | Henmi et al. | 440/66 |

FOREIGN PATENT DOCUMENTS

| | | |
|---|---|---|
| WO | WO 94/08845 | 4/1994 |

* cited by examiner

*Primary Examiner*—Sherman Basinger
(74) *Attorney, Agent, or Firm*—Ingrassia Fisher & Lorenz

(57) ABSTRACT

A waterjet propulsion apparatus having a five blade rotor and an eight blade stator that are located within housing sections that define a water flowpath. The housing and hub are designed such that in operation a nonuniform loading arises on the rotor blades whereby greater pressure impinges on the tip area of the rotor blade than at the hub area of the rotor blade. This configuration increases the efficiency of the waterjet while minimizing negative effects of cavitation.

22 Claims, 3 Drawing Sheets

WATERJET PROPULSION APPARATUS

FIELD OF THE INVENTION

This invention relates generally to waterjet propulsion apparatuses and, more specifically, to an improved waterjet propulsion apparatus combining a five-blade rotor and an eight blade stator.

BACKGROUND OF THE INVENTION

The main components of a waterjet propulsion apparatus include a rotor (also sometimes referred to as an impeller) and a stator located downstream thereof, both of which are located within a water conduit or flowpath. At a first end of the flowpath, upstream of the rotor, is a water inlet, where water enters the flowpath for acceleration by the rotor. The accelerated water is then "straightened" by the stator, which eliminates the swirl imparted to the water by the rotor. At a second end of the conduit, downstream of the stator, is located a nozzle or water outlet, where water that has been accelerated by the rotor and straightened by the stator passes through a funnel-shaped nozzle, further increasing thrust. This thrust is used to power a water vehicle.

The rotor is turned by a shaft that is driven by the water vehicle engine. The stator is stationary. Each of these components is located within a housing, which defines the flowpath.

One problem encountered by prior art waterjet apparatuses includes cavitation. This occurs when fluctuations in the magnitude and direction of water-flow velocities causes fluctuating pressures on a blade row. If severe enough, this can reduce surface pressures on blade rows that are below the vapor pressure of water, causing the water to boil. When this occurs, bubbles of water vapor that are created on the surface of blades can coalesce into large cavities that remain attached to the blades or that may be shed from the blade surfaces and travel downstream. Where cavitation is sufficiently severe, the flow of water through the system is impeded, resulting in cavitation or thrust breakdown. Cavitation can also lead to implosion of the bubbles back into a liquid state, potentially causing physical damage to the apparatus.

It is also desired to have a waterjet propulsion apparatus that can absorb power at relatively low RPM's. Such a design offers increased efficiency and thrust.

Other deficiencies with prior art apparatuses include excessive conduit length, relatively high weight, and relatively high cost. Such features can be especially undesirable where a waterjet propulsion apparatus is intended to power a military water vehicle.

A need therefore exists for a waterjet propulsion apparatus that reduces cavitation, reduces conduit length, decreases weight, lowers cost, and improves efficiency.

SUMMARY OF THE INVENTION

There has now been developed a waterjet propulsion apparatus that satisfies one or more of the above-noted deficiencies. In one embodiment, the apparatus comprises, in combination: a rotor comprising a plurality of rotor blades coupled to a hub; wherein the rotor has five rotor blades; a first housing section surrounding the rotor; a stator comprising a plurality of stator blades coupled to a stator hub; wherein the stator has eight blades coupled to the stator hub; and a second housing section surrounding the stator.

In another embodiment, the apparatus comprises, in combination: a rotor comprising a plurality of rotor blades coupled to a hub; wherein the rotor has five the rotor blades; a first housing section surrounding the rotor; wherein clearance between tips of the rotor blades and an interior surface of the first housing section is within the range of about 0.050" and 0.150"; a stator comprising a plurality of stator blades coupled to a stator hub; wherein the stator has eight blades coupled to the stator hub; and a second housing section surrounding the stator; wherein a distance from a trailing end of the stator blades and a downstream end of the second housing section is in the range of from about one to about two inches; and wherein an internal diameter at a downstream end of the second housing section is in the range of from about eight to about ten inches.

In a further embodiment, the apparatus comprises, in combination: a rotor comprising a plurality of rotor blades coupled to a hub; wherein the rotor has five the rotor blades; wherein a total weight of the rotor blades is about 114 lbm; wherein total blade area of the rotor blades is about 854 $in^2$; a first housing section surrounding the rotor; wherein clearance between tips of the rotor blades and an interior surface of the first housing section is within the range of about 0.050" and 0.150"; a stator comprising a plurality of stator blades coupled to a stator hub; wherein the stator has eight blades coupled to the stator hub; and a second housing section surrounding the stator; wherein the second housing section defines a combined stator housing and nozzle; wherein the second housing section tapers to from an upstream end having a first diameter to a downstream end having a second diameter that is smaller than the first diameter; and wherein a downstream end of the stator hub extends downstream of the downstream end of the stator housing.

DETAILED DESCRIPTION OF A PREFERRED EMBODIMENT

Figure 1:
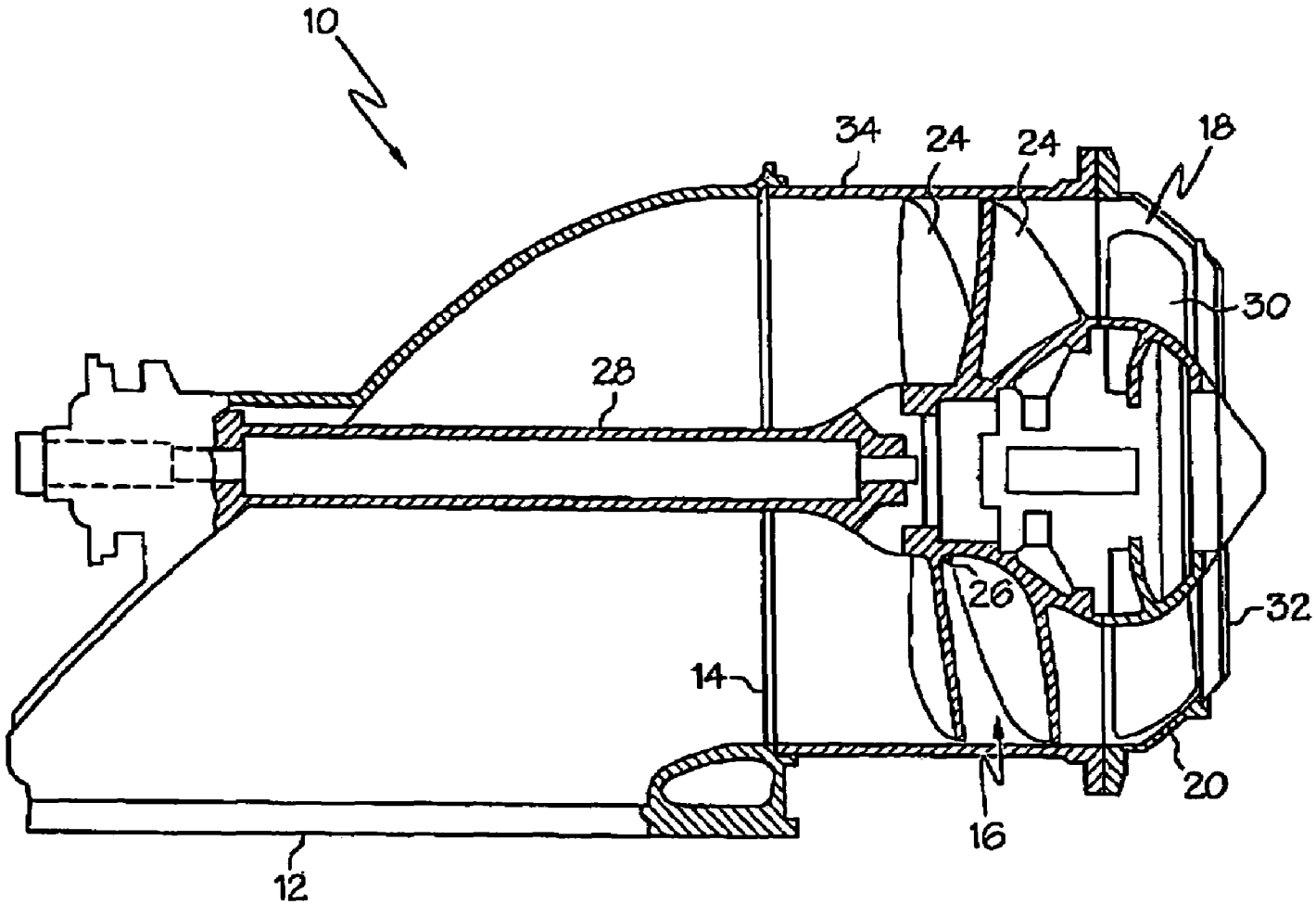
FIG. 1 is a side, cross-sectional view of a waterjet propulsion apparatus, consistent with an embodiment of the present invention.

Referring first to FIG. 1, the flowpath and main components of a waterjet propulsion apparatus 10 is shown. Water flows upward and rearward (or downstream) through entry point 12. It then passes through inlet 14, and continues downstream to the rotor 16 (see also FIG. 2). The water then reaches the stator 18. Finally, the water exits the tapered, integrated, stator housing/nozzle 20 ("stator housing/nozzle 20").

Figure 2:
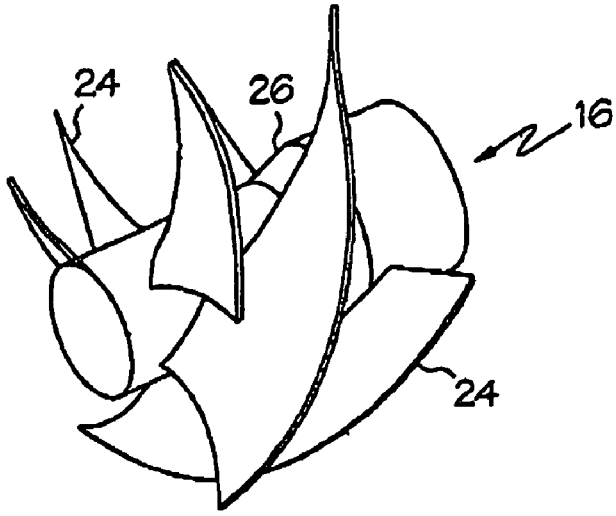
FIG. 2 is a perspective view of the rotor portion of a waterjet propulsion apparatus, consistent with an embodiment of the present invention.

Referring now to FIGS. 1 and 2, the features of the rotor 16 are addressed in greater detail. The rotor 16 comprises five blades 24 mounted onto a hub 26. The hub 26 preferably has a substantially cylindrical upstream section, and tapers outward to a downstream section having a greater diameter than the upstream section.

Figure 4:
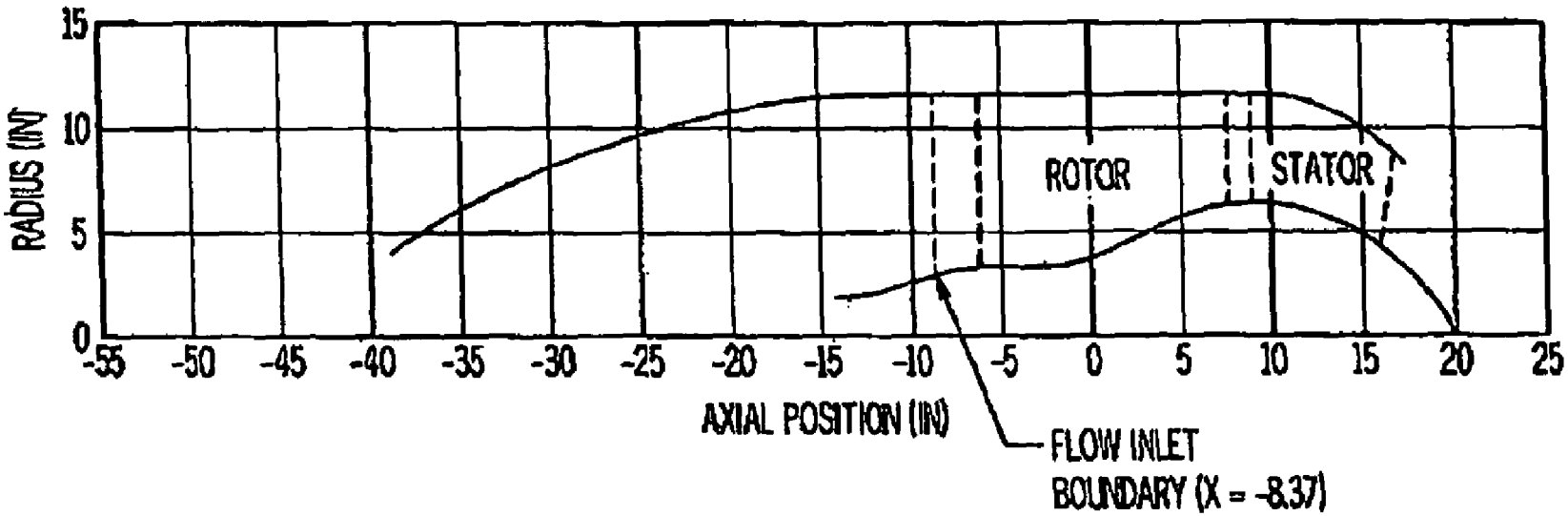
FIG. 4 is a graphical representation of the flowpath of a waterjet propulsion apparatus, consistent with an embodiment of the present invention.

It is preferred that the loading of the blades 24, horn hub 26 to the blade tip, be non-uniform. Non-uniform blade loading permits a shorter blade length, and thus contributes to an overall shortening of the flowpath. The total blade weight is preferred to be in the range of about 100 to 120 lbs with 114 lb being preferred. Total blade area is preferred to be in the range of about 800 to 900 $in^2$ with 854 $in^2$ being preferred. Preferred blade length for the blades 24, and position within the flowpath, is illustrated in FIG. 4.

The rotor 16 is driven by drive shaft 28, which drive shaft 28 is coupled at its upstream end to the water vehicle engine (not shown). It is preferred that the rotor 16 operate over a range of RPM's encountered in waterjet watercraft. It is preferred that an RPM between approximately 1000 to 1200 rpm provide maximum efficiency, with 1,113.92 rpm being considered ideal. At this operating point, maximum engine power will still be absorbed if the load is increased.

Figure 3A:
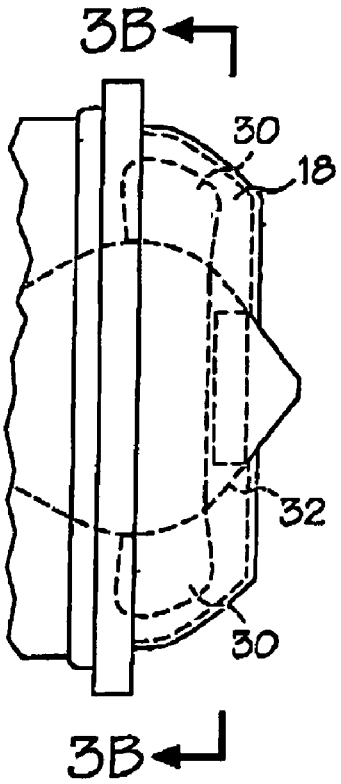
FIG. 3A is a side view of the stator and nozzle portions of a waterjet propulsion apparatus, consistent with an embodiment of the present invention.
Figure 3B:
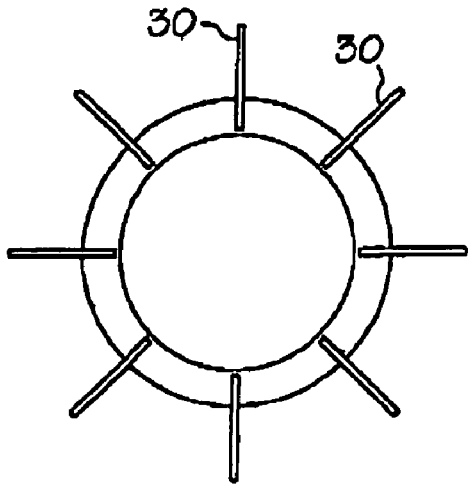
FIG. 3B is an end view of the stator portion of a waterjet propulsion apparatus, consistent with an embodiment of the present invention, taken along line 3B—3B in FIG. 3A.

Referring to FIGS. 1 and 3, the stator 18 is addressed. The stator 18 comprises eight blades 30 mounted onto a hub 32. The hub 32 preferably has a tapered configuration, and tapers from an area of greater diameter at the upstream end, which is preferably about the same diameter as the downstream section of the hub 26, to an area of substantially less diameter at its downstream end. Blade length for the blades 24, and position within the flowpath, is illustrated in FIG. 4.

Each of the rotor 16 and stator 18 are located within housing sections that contribute to the definition of the flowpath. With respect to the rotor 16, it is located within housing section 34. As shown in FIG. 1, housing section 34 preferably has a constant internal diameter. For optimum rotor efficiency, clearance between the outer tip of each blade 24 and the interior surface of the housing 34 is within the range of about 0.050 in and 0.150 in, with 0.050 in being preferred.

The stator 18 is located within stator housing/nozzle 20. It can be seen that stator housing/nozzle 20 tapers, from an internal diameter that is substantially the same as the internal diameter of housing section 34, to an internal diameter that is smaller. Preferably, the internal diameter at the downstream terminus of the stator housing/nozzle 20 is in the range of from about eight to about ten inches, with a radius of about 8.85 inches being preferred.

Attention is particularly drawn to FIG. 1, which illustrates that the downstream end of hub 32 extends beyond the downstream end of stator housing/nozzle 20. The portion of the hub 32 extending out of the flowpath is also referred to as the tailcone. It is preferred that the distance from the trailing end of stator blades 30 and the downstream end of the stator housing/nozzle 20 be in the range of approximately one to two inches, with a distance of about 1.29 inches being preferred.

The rotor and stator blade configurations are selected in part to promote nonuniform loading. Nonuniform loading, as measured by radial direction along the rotor, for example aids in the control of cavitation. In a preferred design there is more head rise at the tip of the blade as compared with the hub of the blade for a given RPM. This nonuniform loading allows more energy and more work at the tip of the rotor.

The overall configuration of the water flowpath as defined by the housing and rotor/stator hub is also selected to provide a preferred pressure rise, flow, and power density. Moreover, these design criteria are preferably measured at a given RPM. Preferably a pressure rise of approximately 99.4 ft of $H_2O$ is provided at a 16 mph design speed. At this design speed the water flow is between about 95 to 105 $ft^3$/sec preferably approximately 102 $ft^3$/sec. Additionally the preferred configuration provides a power density, as represented by horsepower/(pump diameter)$^2$. At 1114 RPM, the power density is approximately $1311/(23)^2$ or 2.47.

It should be noted that the waterjet propulsion apparatus 10 of the present invention initially operates with the stator housing/nozzle 20 submerged. At approximately 14 knots, the vehicle begins to hydroplane, thus raising the stator housing/nozzle 20 out of the water so that it is then ejecting water into the air.

The components of the waterjet apparatus may be fabricated of materials suitable for use in a marine environment. Preferably stainless steel is used for high usage life. A 15-5 stainless steel of PH 1150 may be used for rotors, stators, and housing.

The advantages provided by the different embodiments of the invention herein described include a reduction in flowpath/conduit length, a reduction in cavitation, reduced weight, and increased efficiency—as compared to prior art designs.

While the invention has been particularly shown and described with reference to preferred embodiments thereof, it will be understood by those skilled in the art that the foregoing and other changes in form and details may be made therein without departing from the spirit and scope of the invention.

We claim:

1. A waterjet propulsion apparatus comprising, in combination:

a rotor comprising a plurality of rotor blades coupled to a hub, said rotor blades each having a tip and each being shaped so as to have uneven loading from the hub to the tip;

wherein said rotor has five said rotor blades;

a first housing section surrounding said rotor further having an interior surface and wherein said rotor blades are disposed within first housing section so that the tips of the rotor blades define a clearance with respect to the interior surface of the first housing section;

wherein a clearance between each rotor tip and an interior surface of said first housing section is within the range of about 0.050" and 0.150";

a stator comprising a plurality of stator blades coupled to a stator hub;

wherein said stator has eight blades coupled to said stator hub; and a second housing section surrounding said stator.

2. The apparatus of claim 1 wherein a total weight of said rotor blades is between about 110 to 120 lb.

3. The apparatus of claim 2 wherein the total weight of said rotor blades is about 114 lb.

4. The apparatus of claim 2 wherein total blade area of said rotor blades is about 854 $in^2$.

5. The apparatus of claim 4 wherein clearance between tips of said rotor blades and said interior surface of said first housing section is approximately 0.050".

6. The apparatus of claim 5 wherein said second housing section tapers to form an upstream end having a first diameter to a downstream end having a second diameter that is smaller than said first diameter.

7. The apparatus of claim 1 wherein total blade area of said rotor blades is between about 800 $in^2$ to 900 $in^2$.

8. The apparatus of claim 1 wherein said second housing section defines a combined stator housing and nozzle.

9. The apparatus of claim 8 wherein said stator hub further defines a downstream end and wherein said second housing section further defines a downstream end;

and wherein the downstream end of said stator hub extends downstream of said downstream end of said second housing section.

10. The apparatus of claim 9 wherein said second housing section defines an internal diameter and wherein an internal diameter at a downstream end of said second housing section is in the range of from about eight to about ten inches.

11. The apparatus of claim 10 wherein said internal diameter is about 8.85 inches.

12. The apparatus of claim 1 wherein said stator blades further define a trailing end and wherein said second housing section further defines a downstream end;

and wherein the distance from the trailing end of said stator blades and the downstream end of said second housing section is in the range of from about one to about two inches.

13. The apparatus of claim 12 wherein said distance is about 1.29 inches.

14. A waterjet propulsion apparatus comprising, in combination:

a rotor comprising a plurality of rotor blades coupled to a hub, each rotor blade having a tip and each rotor blade being shaped so as to have nonuniform loading as measured from the hub to the tip of each rotor blade;

wherein said rotor has five said rotor blades;

a first housing section surrounding said rotor;

wherein clearance between tips of said rotor blades and an interior surface of said first housing section is within the range of about 0.050" and 0.150";

a stator comprising a plurality of stator blades coupled to a stator hub;

wherein said stator has eight blades coupled to said stator hub; and a second housing section surrounding said stator;

wherein a distance from a trailing end of said stator blades and a downstream end of said second housing section is in the range of from about one to about two inches; and wherein an internal diameter at a downstream end of said second housing section is in the range of from about eight to about ten inches.

15. The apparatus of claim 14 wherein clearance between tips of said rotor blades and said interior surface of said first housing section is approximately 0.050".

16. The apparatus of claim 14 wherein said second housing section defines a combined stator housing and nozzle.

17. The apparatus of claim 14 wherein said internal diameter is about 8.85 inches.

18. The apparatus of claim 14 wherein said distance is about 1.29 inches.

19. A waterjet propulsion apparatus comprising, in combination:

a rotor comprising a plurality of rotor blades coupled to a hub, each rotor blade having a tip and being shaped so that the loading on each rotor blade the tip and the hub is nonuniform;

wherein said rotor has five said rotor blades;

wherein a total weight of said rotor blades is about 114 lbs;

wherein total blade area of said rotor blades is about 854 $in^2$;

a first housing section surrounding said rotor;

wherein clearance between tips of said rotor blades and an interior surface of said first housing section is within the range of about 0.050" and 0.150";

a stator comprising a plurality of stator blades coupled to a stator hub;

wherein said stator has eight blades coupled to said stator hub; and a second housing section surrounding said stator;

wherein said second housing section defines a combined stator housing and nozzle;

wherein said second housing section tapers to form an upstream end having a first diameter to a downstream end having a second diameter that is smaller than said first diameter; and wherein a downstream end of said stator hub extends downstream of said downstream end of said stator housing.

20. The apparatus of claim 19 wherein clearance between tips of said rotor blades and said interior surface of said first housing section is approximately 0.050".

21. The apparatus of claim 19 having a pressure rise of approximately 99.4 ft $H_2O$ of approximately 16 mph watercraft speed.

22. The apparatus of claim 19 having a water flow of between approximately 95 to 105 $ft^3$/sec at approximately 16 mph watercraft speed.

* * * * *

UNITED STATES PATENT AND TRADEMARK OFFICE

CERTIFICATE OF CORRECTION

PATENT NO. : 6,991,499 B2
APPLICATION NO. : 10/664318
DATED : January 31, 2006
INVENTOR(S) : William Facinelli et al.

It is certified that error appears in the above-identified patent and that said Letters Patent is hereby corrected as shown below:

In Column 3, Line 4, replace “horn” with --from--.
In Column 3, Line 8, replace “100 to 120” with --110 to 120--.

Signed and Sealed this

Second Day of October, 2007

JON W. DUDAS
*Director of the United States Patent and Trademark Office*